United States Patent [19]

Lorant et al.

[11] 4,397,892

[45] Aug. 9, 1983

[54] PROCESS FOR THE PRODUCTION OF CHEMICALLY BONDED NON-WOVEN SHEET MATERIALS CONTAINING A BINDER OF MICROHETEROPOROUS STRUCTURE

[75] Inventors: Ivan Lorant; Gyula Murlasits, both of Budapest; Gyula Wlasitsch, Györ; Ferenc Farkas, Györ; Geza Szomolanyi, Györ, all of Hungary

[73] Assignees: Bör-,Mübor-,es Cipöipari kutato Intezet, Budapest; Graboplast, Györi Pamutszövö-es Müborgyar, Györ, both of Hungary

[21] Appl. No.: 372,039

[22] Filed: Apr. 26, 1982

Related U.S. Application Data

[63] Continuation-in-part of Ser. No. 147,350, May 7, 1980, abandoned.

[51] Int. Cl.[3] ..... B05D 5/00

[52] U.S. Cl. ..... 427/245; 427/246; 427/389.9; 427/393.4; 427/381; 428/904

[58] Field of Search ..... 427/389.9, 245, 246, 427/393.1, 393.4, 381; 428/904, 473, 260, 91, 96, 235; 69/21

[56] References Cited

U.S. PATENT DOCUMENTS

| | | | |
|---|---|---|---|
| 3,887,730 | 6/1975 | Rainer et al. | 428/904 X |
| 3,928,704 | 12/1975 | Heidingsfeld et al. | 428/260 |
| 4,002,783 | 1/1977 | Fleissner | 428/904 X |
| 4,143,198 | 3/1979 | Sinn et al. | 428/904 X |
| 4,176,108 | 11/1979 | Caimi et al. | 427/389 |
| 4,208,485 | 6/1980 | Nahta | 521/65 |

*Primary Examiner*—Michael R. Lusignan
*Assistant Examiner*—Thurman K. Page
*Attorney, Agent, or Firm*—Toren, McGeady and Stanger

[57] ABSTRACT

A process for the production of chemically bonded non-woven material, such as synthetic leather, is disclosed wherein a fiber fleece is impregnated with a heat sensitized polymer dispersion and the composition is destabilized to form a porous gel structure. Finally, the polymer is crosslinked at below 150° C. and is dehydrated. Additionally, cut fibers of polyester of polyamide are formed into a fleece and an aqueous dispersion of butadiene-styrene coagulant and a curing composition is impregnated through the fleece. The binder is gelled and cured in superheated steam. The products obtained are soft and possess excellent physical and mechanical properties as well as superior dynamic stressability.

10 Claims, No Drawings

PROCESS FOR THE PRODUCTION OF CHEMICALLY BONDED NON-WOVEN SHEET MATERIALS CONTAINING A BINDER OF MICROHETEROPOROUS STRUCTURE

CROSS-REFERENCE TO RELATED APPLICATIONS

This application is a continuation-in-part of application Ser. No. 147,350, filed May 7, 1980 now abandoned, the contents of which are hereby incorporated by reference.

BACKGROUND OF THE INVENTION

1. Field of the Invention

This invention relates to a process for the production of chemically bonded non-woven sheet materials containing a binder with a microporous or microheteroporous structure. The sheet material formed by the process has extremely advantageous properties rendering it particularly suitable for use as a carrier for synthetic leather.

2. Description of the Prior Art

It is known that the demand for leather for use in the footwear and garment industries as well as material for technical products has vastly increased and this has caused a significant increase in the manufacture and use of synthetic leather. The use and application of synthetic leather products are particularly significant in the footwear industry, in the vehicle manufacturing industry and in the industry manufacturing decorative leather products.

It is also known that the use of synthetic leather in substitution of natural leather makes high demands on the production of synthetic leather in that in its appearance, touch or feel, workability and applicability it should provide a leather effect.

To satisfy these demands, it is known to provide synthetic leathers with a carrier designed to provide predetermined properties in the end product. From this it follows that it is a significant task to ensure that the characteristics of the carrier material meet the desired requirements relating to synthetic leather. This means that the carrier material itself must ensure the advantageous properties of the synthetic leather. Thus, the task of the carrier material can be designated as increasing mechanical strength properties, satisfying the expectations of mechanical and physical properties, a favorable degree of flexibility or bendability of the synthetic leather as well as softness or plasticity, and organoleptic behavior. Taking into account all of these factors, it is particularly significant that the microheteroporosity of the binder has an important role in fulfilling these expectations.

It is known that for chemically strengthening and for manufacturing non-woven sheet materials, the following processes are employed in general:

A non-woven sheet material containing a binder of microheteroporous structure can be manufactured by impregnating a needled and shrunk fiber fleece with a solution of a polymer or a mixture of polymers, e.g., a polyurethane dissolved in dimethylformamide, then the polymer is coagulated in a liquid solvent which does not dissolve the polymer (water-miscible solvent), e.g., water, see British Patent Specification No. 1,091,935 and U.S. Pat. Nos. 3,676,206, 3,483,283, 3,067,482 and 3,228,786.

A disadvantage of this process is that it requires the use of solvents which are harmful to humans and which are inflammable, explosive and its cost are high. The process is also disadvantageous from the point of view of environmental pollution. Because of these reasons, the manufacture of products made by this process has not been adopted on a wide scale.

A further process is known wherein the needle-punched and shrunk fiber fleece is impregnated with an aqueous dispersion of polymers which, after destabilization of the dispersion, is dried and hardened or cured, see British Patent Specification No. 1,273,311, U.S. Pat. Nos. 3,539,388, 3,639,146, 3,523,059 and 3,228,786.

The process operating with an aqueous dispersion is free from the technological disadvantages and other harmful effects mentioned above. Hence, the use of such a process is more advantageous and is in wide use. However, it is to be considered a significant disadvantage that the non-woven sheet material product of the aqueous dis- persion processes contains a binder material which is not of microheteroporous structure, and therefore, its properties and characteristics do not meet certain requirements.

SUMMARY OF THE INVENTION

One aim of the present invention is to provide a process capable of avoiding the above disadvantages and producing a non-woven sheet material containing a binder which has the required favorable microheteroporous structure by utilizing the process deemed to be most advantageous, namely, the aqueous polymer dispersion process. Moreover, the invention seeks to provide a manufacturing technology which is not too intricate, and with the aid of which the product can be produced in an economical manner and which does not transgress environmental protection requirements.

A further aim of the process is to ensure the colloid-chemistry properties which can favorably influence the final product characteristics in the non-woven sheet material.

The invention is based on the discovery that the favorable properties required for non-woven sheet material can be fulfilled while at the same time, providing a microheteroporous binder structure by using an impregnation process based on an aqueous dispersion, that is to say, on chemical bonding, wherein at the stage of chemical bonding with an aqueous dispersion and after destabilizing the dispersion, a "primary" porous polymer binder structure can be formed.

If the polymer is left unchanged in this structure, then the thus formed primary porous structure is destroyed in the subsequent phase of the manufacturing technology, namely, in the drying stage. The thus obtained secondary structure differs from the primary structure because of the coalescence of the polymer particles and does not have a microheteroporous structure; on drying or dewatering, the particles coalesce and the primary structure is destroyed. However, if before drying the binder, the polymer is crosslinked in the water containing polymeric microheteroporous system, then the primary structure is effectively fixed or preserved. In such a crosslinked polymer system, the primary porous structure changes only negligibly on drying.

By suitably carrying out this technology, a gel structure of good porosity can be produced from a heat-sensibilized dispersion under the effect of heat, and then the polymer forming the gel is crosslinked with steam or by some other method to obtain a microheteroporous binder structure.

More particularly, we have found that these objects can be achieved by first impregnating a fiber fleece with a heat-sensitized aqueous polymer dispersion containing from about 1 to 60% by weight of a hydratable sulfonic compound which is a water soluble condensation product of a diarylsulfone derivative and an arylsulfonic acid and a plasticizer which is composed of a non-ionogenic compound containing polar groups capable of hydration. The polymer dispersion is then destabilized and crosslinked by heating the impregnated fleece at a temperature of less than about 150° C. Finally, the crosslinked polymer in the fleece is dehydrated.

Hydratable sulfonic compounds suitable for use in the present invention include sulfonic compounds known in the art and having the general formula

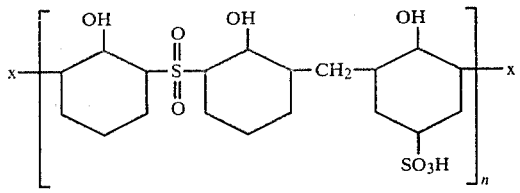

wherein x are terminal groups.

Of particular interest are those sulfonic compounds which are the condensation product of dioxydiphenylsulfone and paraphenol sulfonic acid.

The non-ionogenic compounds which are used in the present invention are used to increase the hydrophilicity. Such compounds generally include water soluble aliphatic bi- and/or trivalent alcohols and water soluble aliphatic polyetherglycols. In particular, ethylene glycol, diethyleneglycol, glycerol, polyethylene glycol, or polypropylene glycol may be used. Also, alkoxybutyl acetates wherein the alkoxy group contains 1 to 4 carbon atoms may be used. Typical of this class of compounds would be 3-methoxybutyl acetate.

DESCRIPTION OF THE PREFERRED EMBODIMENT

In a preferred embodiment of the process according to the invention, the impregnation of the fiber fleece is carried out with a heat-sensibilized aqueous polymer dispersion containing 1–30% solvent emulsion.

In a further preferred embodiment of the process, aqueous dispersion containing gaseous phase, crosslinkable polymers are used as the binder for the impregnation, in an amount calculated on the fibrous material of 50–200 weight percent, expediently 100 weight %. In a further advantageous embodiment, non-ionogenic compounds containing polar groups are used in the process for softening or plasticizing the polymer, wherein the polar groups are capable of hydration.

In a further preferred embodiment of the process, in the interest of ensuring good water vapor absorption for the non-woven sheet material, the microheteroporous binder or the microheteroporous matrix structure is formed in the presence of 1–60 weight %, expediently 10–20 weight %, of a hydratable sulfonic compound calculated on the dispersion.

The process according to the invention thus provides a possibility of eliminating the aqueous polyurethane coagulation technology while retaining its advantageous properties and obtaining a binder of microheteroporous structure by using polymer dispersions in the course of chemically bonding the fibers of the fleece, whereby the manufacturing technology is greatly simplified, and is rendered more economical as well as more favorable with regard to environmental protection.

In the process according to the invention, conjugated diene (e.g. butadiene) containing copolymer dispersions, advantageous butadiene acrylonitrile copolymers, may be used in the production of chemically bonded non-woven sheet materials, which dispersions have the following colloidal-chemical properties.

They are heat-sensitizable, on destabilization, a solid gel is formed from them directly or with the aid of suitable additives, by using a suitable method of polymer in the aqueous gel can be crosslinked before syneresis of the gel.

On the basis of the above, organopolysiloxanes (e.g., Coagulant WS, Bayer A.G.), polyethers (e.g. Ciago G.A.3—A.K.U. Goodrich) etc. may be used for heat-sensibilizing the dispersions with a simultaneous utilization of non-ionic surfactants, e.g., Emulvin W (aromatic polyglycol ether, Bayer AG) ensuring stability at room temperature. By adjusting the composition, the destabilizing temperature of the dispersion may be varied, e.g., between 36°–70° C., expediently between 36°–46° C.

Furthermore, it has been possible to achieve that the aqueous polymer dispersion containing heat-sensibilizing and curing agents should be destabilizable under the effect of heat (heat shock, infrared radiation, steam) and thus a passably solid gel may be obtained. This can be achieved for polymers of relatively low vitrification temperature by adding a small quantity of plasticizer, e.g., Perbunan N 3415 M (butadiene/acrylonitrile copolymer aqueous dispersion, solids content 47.5%—Bayer AG), Perbunan KA 8194 (butadiene/acrylonitrile copolymer aqueous dispersion, solids content 45%—Bayer AG). With dispersions of higher vitrification temperature (Hycar 1570 H/69, butadiene/acrylonitrile copolymer aqueous dispersion, solids content 47%, AKU Goodrich; Revinex L 68 V 40, butadiene/acrylonitrile copolymer aqueous dispersion, solids content 45%, Revertex Ltd.), a greater amount of plasticizer is required.

The plasticization may take place by mixing with a softer polymer dispersion or with a solvent emulsion (e.g. Butoxil, aqueous emulsion of 4-methoxybutyl acetate) or with a non-polymeric softener (e.g. ethylene glycol or diethylene glycol).

If the softening is partially temporary, then the mechanical rigidity can be increased. The softening is required for ensuring the required autohesion of the polymer particles.

Partial and temporary softening has the advantage that the gel structure is then formed from swollen polymer particles and thus on the removal of the softener the steam-cured (crosslinked) gel structure shrinks in proportion to the extent of the previous swelling. Chemically bonding the fiber fleece has the result that on shrinking, the microheteroporous binder can separate from the fibers and thus further increase the microheteroporosity. With such a process, one can assure the creation of a microheteroporous binder matrix structure in the fiber fleece. Non-woven sheet materials made in this way are distinguished by high plasticity or softness, favorable hygienic properties and good shapability.

It has furthermore been ascertained that in the case of curing crosslinking in an aqueous medium polymer crosslinking can be set at a relatively low temperature of 110°-120° C. by using superheated steam. For this, in addition to the customary curing agents (S, ZnO), ultra-strong accelerators, e.g., dithiourea derivatives, of synergistic mutual effect are expediently used.

Thus, by utilizing the process according to the invention, it has become possible to produce a non-woven, synthetic leather-carrying sheet material which has advantageous properties and which satisfies requirements and expectations and which contains a microheteroporous binder or binder matrix formed from aqueous dispersions of polymers.

Of particular interest is the production of a hydrophile non-woven sheet material which is chemically strengthened by a microheteroporous binder wherein the fiber fleece was first obtained from cut fibers by needle punching and shrinking. Such a non-woven sheet is impregnated with an aqueous butadiene acrylonitrile copolymer dispersion which contains from about 10 to 20 parts by weight of a vulcanization agent and from about 0.5 to 10 parts by weight of a heat-sensibilizing agent based on 100 parts by weight of the butadiene acrylonitrile copolymer dispersion. On a dry basis, the content would be in the range from about 20 to 40%.

The polymer dispersion may then be coagulated at a temperature between about 40° to 70° C. and then crosslinked at a temperature between about 110° to 120° C. The material is then dried at a temperature between about 100° and 160° C.

The polymer dispersion used also contains from about 1 to 20 parts by weight of non-ionogenic compounds. As noted, these may be either water soluble aliphatic bi- or trivalent alcohols, water soluble aliphatic polyether glycol plasticizers, or aqueous emulsions of $C_1$ to $C_4$ alkoxybutyl acetates. The polymer dispersion also contains from about 10 to 30 parts by weight of a water soluble condensation product of the diarylsulfone derivative and an arylsulfonic acid.

The process according to the invention is described below with the aid of non-limiting examples and Table 1 which summarizes experimental measurement results.

EXAMPLE 1

From a mixture of cut fibers containing 40% shrinkable polyester (1.2 den, 60 mm), 50% polyamide (1.4 den, 40 mm), and 10% viscose (1.5 den, 38 mm), a shrunk fiber fleece is produced by carding, cross-laying, needle-punching (600 needles per $cm^2$) and shrinking (10 minutes in water of 66° C.). The thus obtained shrunk fiber fleece of 4.8±0.1 mm thickness and 1000 $g/m^2$ weight per area is impregnated with the following mixture of aqueous dispersions:

| Ingredients | | Percent by weight |
|---|---|---|
| Perbunan N 3415 M | | 60 |
| Perbunan KA 8194 | | 40 |
| Diethylene glycol | | 5 |
| Emulvin W (20%) | | 8 |
| Coagulant WS (10%) | | 1.5 |
| Curing (vulcanization) paste | | 15 |
| Active Zn | 5 | |
| $TiO_2$ RFKD | 5 | |
| Colloidal sulfur | 2 | |
| Vulkacit LDA(1) | 1 | |
| Vultamol (5%)(2) | 24 | |
| Ultra-accelerator KA 9054(3) | | 1.5 |

-continued

| Ingredients | Percent by weight |
|---|---|
| Water | 30 |

(1)zinc diethyl dithiocarbamate - Bayer AG
(2)condensation product of naphthalene sulfonic acid and formaldehyde
(3)sodium diisopropyl dithiocarbamate - Bayer AG After impregnation, the product is wrung out between foulard cylinders so that the quantity of binder calculated on the final fibrous material should be about 100%.

The binder dispersion is gelled for 1 minute at 160° C., then cured (crosslinked) in superheated steam at a temperature of 110° C. Finally, the product is dried at 120° C. in a drying tunnel.

The thus obtained chemically bonded non-woven sheet material is very soft, has a good feel (touch) and is extremely well suited for use as a carrier for synthetic leather. Contact electron microscope pictures taken of this structure have verified that the structure of the binder material was microheteroporous.

EXAMPLE 2

The needles and shrunk fiber fleece produced in the manner described in Example 1 was impregnated with the following mixture:

| Ingredients | Percent by Weight |
|---|---|
| Hycar 1570 H 69 | 50 |
| Perbunan N 3415M | 50 |
| Ethylene glycol | 5 |
| Emulvin W (20%) | 5.0 |
| Coagulant WS (10%) | 1.5 |
| C.G.A. 3 (10%) | 1.5 |
| Curing (vulcanization) paste* | 1.5 |
| Ultra-accelerator KA 9054 | 1.5 |
| Water | 30 |

The subsequent experimental methodology corresponds to that of Example 1.

On destabilizing the hard Hycar 1570 H 69 dispersion softened with a Perbunan N 4315 M dispersion, a solid gel structure is formed which can be fixed by steam curing (vulcanization) with the aid of the effective crosslinking system present, and the resulting binder structure becomes microheteroporous.

EXAMPLE 3

The needle-punched and shrunk fiber fleece produced in the manner described in Example 1 was impregnated with an aqueous dispersion mixture of the following composition:

| Ingredients | WEIGHT % |
|---|---|
| Hycar 1570 H 69 | 100 |
| Diethylene glycol | 3 |
| Butoxil emulsion (50%) | 2.5 |
| Emulvin W (20%) | 1.5 |
| C.G.A. 3 (10%) | 1.5 |
| Curing (vulcanization) paste* | 15 |
| Ultra-accelerator KA 9054 | 1.5 |
| Water | 30 |

*composition is identical to that of Example 1

The subsequent experimental methodology corresponds to that of Example 1.

A non-woven sheet material is obtained wherein the binder is of a microheteroporous matrix structure.

On destabilizing the polymer particles which are temporarily softened by the emulsion of solvent (Butoxil), a solid gel is formed, the structure of which can be fixed by crosslinking in steam. On drying, i.e., driving off the solvent, the microheteroporous matrix is formed.

EXAMPLE 4

The needle-punched and shrunk fibrous fleece prepared in the manner described in Example 1 is impregnated with the following mixture:

| Ingredients | Percent by Weight |
|---|---|
| Revinex 68 V 40 | 100 |
| Diethylene glycol | 15 |
| Emulvin W (20%) | 5 |
| Coagulant WS | 1 |
| Curing (vulcanization) paste* | 15 |
| Ultra accelerator KA 9054 | 1.5 |
| Water | 50 |

*composition is as described in Example 1

The methodology of the experiment in its subsequent stages correspond to that of Example 1.

In carrying out this process, a non-woven sheet material may be produced in which the binder is present as a microheteroporous matrix. After curing by steam and in the course of drying, considerable shrinkage takes place in which the microporous binder solidifies and the pore sizes are reduced.

By taking pictures with a contact electron microscope, it may be verified that a significant proportion of the fibers is disposed in "channels" without being adhesively bound. Because of this and the fine microheteroporous structure of the binder, the thus obtained non-woven carriers are very soft, their physical and mechanical properties are very good and their dynamic stressability is excellent.

-continued

| Ingredients | Percent by Weight |
|---|---|
| Curing (vulcanization) paste* | 15 |
| Ultra accelerator KA 9054 | 1.5 |
| Water | 50 |
| Synthanol Super N (condensation product of dioxydiphenylsulfone) | 19 |

*composition as described in Example 1

Thereafter, the experimental methodology corresponds to that described in Example 1.

With this process, a non-woven carrier having a microheteroporous structure is produced, which is very soft, has a very high water vapor absorption, excellent physical and mechanical properties as well as a first class dynamic stressability.

EXAMPLE 6

(Comparison example—Prior Art Process)

In this example, the needled and shrunk fiber fleece produced in the manner described in Example 1 is impregnated with a dispersion of the composition described in Example 4 with the difference that the diethylene glycol, which insures the softening of the hard Revinex 68 V 40 dispersion and thus the solid gel structure, is omitted. Thereafter, the methodology of the experiment is identical to that of Example 1.

The non-woven sheet material thus obtained contains a binder which does not acquire a microheteroporous structure. Consequently, it is stiffer, its organoleptic and hygienic properties are of poorer quality than those of the non-woven sheet material containing a binder of microheteroporous matrix structure obtainable by the process according to the present invention.

The test results are summarized in Table 1 and clearly show the excellent properties of the non-woven sheet material obtained in accordance with the present invention.

TABLE 1

| Characteristics Structure of | Comparative Experiment Non-microhetero-porous | Non-woven Sheet Material According to Examples: 1 Micro-hetero-porous | 2 Micro-hetero-porous | 3 Micro-hetero-porous | 4 Micro-hetero-porous | 5 Micro-hetero-porous |
|---|---|---|---|---|---|---|
| Rupture strength H/K kp/cm$^2$ | 102/126 | 90/93 | 100/126 | 81/113 | 90/126 | 95/120 |
| Rupture elongation H/K % | 106/102 | 92/81 | 116/100 | 122/120 | 99/105 | 98/202 |
| R 50% b.w. H/K kg/cm | 46/61 | 40/57 | 45/65 | 35/40 | 45/63 | 40/65 |
| Flexural rigidity H/K p/mm | 53/63 | 25/30 | 36/45 | 50/51 | 30/40 | 30/40 |
| Water vapor absorptivity % | 4.6 | 6.3 | 7.8 | 6.1 | 10.0 | 33 |
| Bally type repeated bending or buckling 200 Ko H/K | C/C | E/E | B/B | B/B | B/B | B/B |

EXAMPLE 5

The needled and shrunk fiber fleece prepared in the manner described in Example 1 is impregnated with the following mixture:

| Ingredients | Percent by Weight |
|---|---|
| Revinex 68 V 40 | 100 |
| Diethylene glycol | 15 |
| Emulvin W (20%) | 5 |
| Coagulant WS | 1 |

EXAMPLE 6

The needle-punched and shrunk fiber fleece produced in the manner described in Example 1 was impregnated with an aqueous dispersion mixture of the following composition:

| Ingredients | Percent by Weight |
|---|---|
| Revinex 68 V 40 | 100 |

-continued

| Ingredients | Percent by Weight |
|---|---|
| Polypropylene glycol 300 | 10 |
| Emulvin W (20%) | 5 |
| Coagulant WS (10%) | 5 |
| Vulcanization paste* | 15 |
| Ultra accelerator KA 9054 | 1.5 |
| Water | 50 |
| Tanigan 3LN (diarylsulfone derivative - Bayer AG) | 10 |

*composition is identical to that described in Example 1

The subsequent experimental methodology corresponds to that described in Example 1.

During the destabilization of the Revinex 68 V 40 dispersion plasticized with the mixture of polymeric and monomeric plasticizers and blended with the condensation product of a diarylsulfone derivative, a solid, hydrophilic gel is formed which can be fixed in the presence of water.

By this process, a hydrophilic, non-woven sheet material of microheteroporous matrix structure can be obtained which is very soft and possesses great water vapor absorption, good physico-mechanic characteristics and excellent dynamic properties (Bally type repeated flexural endurance test).

EXAMPLE 7

The needle-punched and shrunk fiber fleece produced in the manner described in Example 1 was impregnated with an aqueous dispersion mixture of the following composition:

| Ingredients | Percent by Weight |
|---|---|
| Revinex 68 V 40 | 100 |
| Polypropylene glycol 300 | 10 |
| Emulvin W (20%) | 5 |
| Coagulant WS (10%) | 5 |
| Vulcanization paste* | 15 |
| Ultra accelerator KA 9054 | 1.5 |
| Water | 50 |
| Tanigan 3 LN | 10 |

*composition is identical to that described in Example 1

The subsequent experimental methodology corresponds to that described in Example 1.

During the destabilization of the Revinex 68 V 40 dispersion plasticized with the mixture of polymeric and monomeric plasticizers and blended with the condensation product of a diarylsulfone derivatives a solid, hydrophilic gel is formed which can be fixed in the presence of water.

By this process, a hydrophile non-woven sheet material of microheteroporous matrix structure can be obtained which is very soft and possesses great water absorption, good physico-mechanic characteristics and excellent dynamic properties (Bally type repeated flexural endurance test).

EXAMPLE 8

The needle-punched and shrunk fiber fleece produced in the manner described in Example 1 was impregnated with an aqueous dispersion mixture of the following composition:

| Ingredients | Percent by Weight |
|---|---|
| Perbunan N 3415 M | 100 |
| Polyethylene glycol 300 | 10 |
| Emulvin W (20%) | 5 |
| Coagulant WS (10%) | 0.8 |
| Vulcanization paste* | 15 |
| Ultra accelerator KA 9054 | 1 |
| Water | 30 |
| Synthanol Super N | 15 |
| Synthanol Super S | 15 |

*composition is identical to that described in Example 1

The subsequent experimental methodology corresponds to that of Example 1.

During the destabilization of the Perbunan N 3415 M dispersion plasticized with a polymeric plasticizer and blended with condensation products of diarylsulfone derivatives a solid, hydrophile gel is formed which can be crosslinked in the presence of water.

By this process, a hydrophile, non-woven sheet material of microheteroporous structure can be obtained which has great water vapor absorption, is very soft due to its microstructure, and possesses good physico-mechanic characteristics and good dynamic properties (Bally type repeated flexural endurance test).

EXAMPLE 9

(Comparison example—not of the present invention)

The needled and shrunk fiber fleece is impregnated with a dispersion which does not contain either the pasticizers ensuring the forming of solid gel structure crosslinkable in the presence of water or the sulfone derivatives increasing the hydrophilicity.

| Ingredients | Percent by Weight |
|---|---|
| Revinex 68 V 40 | 100 |
| Emulvin W (20%) | 5 |
| Coagulant WS (10%) | 1 |
| Vulcanization paste* | 15 |
| Ultra accelerator KA 9054 | 45 |
| Water | 50 |

*composition is identical to that described in Example 1

After impregnation, the product is wrung between Foulard-cylinders so that the quantity of the binder calculated on the fibrous material should be about 100%.

The binder dispersion is gelled for 1 minute at 160° C. The product so obtained is dried in a drying tunnel at 120° C. and then vulcanized for 10 minutes at 140° C.

The sheet material so obtained does not possess a microheteroporous structure so it is stiffer and its organoleptic and hygienic properties are of poorer quality than those of the non-woven sheet material of microheteroporous matrix structure.

The test results are summarized in Table 2 and verify the excellent properties of the non-woven sheet material obtained by the process of the present invention.

TABLE 2

| Characteristics | Non-woven Sheet Material According to Examples: | | | | | | | |
|---|---|---|---|---|---|---|---|---|
| | 1 | 2 | 3 | 4 | 5 | 7 | 8 | 9 |
| Structure of the binder | Micro-hetero-porous | Micro-hetero-porous | Micro-hetero-porous matrix | Micro-hetero-porous matrix | Micro-hetero-porous matrix | Micro-hetero-porous matrix | Micro-hetero-porous matrix | (comparison) Non-micro-hetero-porous |
| Tensile strength H/K* N/mm²/Msz.***** 871/6/ | 9.0/9.3 | 10.0/12.6 | 8.1/11.3 | 9.0/12.6 | 9.5/12.0 | 9.8/11.8 | 8.8/9.2 | 10.0/12.6 |
| Tensile elongation H/K %/Msz 871/6/ | 92/81 | 116/100 | 122/120 | 99/105 | 98/102 | 102/109 | 110/115 | 106/102 |
| 50% modulus H/K N/mm² /Msz. 871/6/ | 4.0/5.7 | 4.5/6.5 | 3.5/4.0 | 4.5/6.3 | 4.0/6.5 | 3.8/5.2 | 3.2/4.6 | 4.6/6.1 |
| Flexural rigidity** H/K N/mm | 0.25/0.30 | 0.36/0.45 | 0.50/0.51 | 0.30/0.40 | 0.30/0.40 | 0.32/0.38 | 0.23/0.30 | 0.58/0.63 |
| Water vapor absorption*** %/Msz. 5448/7/ | 6.3 | 7.8 | 6.1 | 10.0 | 33.0 | 20.5 | 26.2 | 4.0 |
| Bally type repeated flexural endurance H/K ratio****200 Kc/Msz. 871/21/ | 2 | 1 | 1 | 1 | 1 | 1 | 1 | 2 |

*measured in length/cross direction
**measured according to Frank: power for flexing a specimen of 2.5 × 15 cm in 45°
***add-on in % of a specimen conditioned in a space of 20° C. and 65% relative humidity measured in a space of 20° C. and 100% relative humidity for 24 hours
****1 = no damage; 2 = little damage
*****Hungarian Standard

We claim:

1. A process for the production of a chemically bonded non-woven material containing a binder having a microheteroporous structure comprising the steps of:
   (a) impregnating a fiber fleece with a heat sensitized aqueous polymer dispersion containing from 1 to 60% by weight of a hydratable sulfonic compound, which is a water soluble condensation product of a diarylsulfone derivative and an arylsulfonic acid, and a plasticizer composed of a non-ionogenic compound which contains polar groups capable of hydration;
   (b) destabilizing the polymer dispersion;
   (c) crosslinking the polymer by heating the impregnated fleece at a temperature of less than 150° C.; and
   (d) dehydrating the crosslinked polymer in the fleece.

2. The process of claim 1 wherein the impregnation of the fibrous fleece is carried out with a heat sensitized aqueous polymer dispersion containing a 1–30% solvent emulsion.

3. The process of claim 1 or 2 wherein an aqueous dispersion containing a crosslinkable polymer is used as a binder for the impregnation in an amount of from 50 to 200 weight percent calculated on the fibrous material.

4. The process of claim 3 wherein the crosslinkable polymer is a conjugated diene containing dispersion.

5. The process of claim 3 wherein about 100 weight percent of crosslinkable polymer is used as a binder.

6. The process of claim 1 wherein 10 to 20 weight percent of hydratable sulfonic compound, calculated on the dispersion, is used.

7. A process for the production of a chemically bonded non-woven material containing a binder having a microheteroporous structure comprising the steps of
   impregnating a needle-punched preshrunk fiber fleece formed from cut fibers with an aqueous butadiene acrylonitrile copolymer dispersion containing from about 10 to 20 parts by weight of vulcanization agent and from about 0.5 to 10 parts by weight of a heat sensitizing agent, calculated on 100 parts by weight of the butadiene acrylonitrile copolymer dispersion, said dispersion further containing from about 1 to 20 parts by weight of a water soluble aliphatic bi- or trivalent alcohol, a water soluble aliphatic polyether glycol plasticizer or an aqueous emulsion of an alkoxybutyl acetate, the alkyl portion of which contains from 1 to 4 carbon atoms, and from about 10 to 30 parts by weight of a water soluble condensation product of a diarylsulfone derivative and an arylsulfonic acid, said dispersion having a solids content of about 20 to 40% by weight;
   coagulating the polymer dispersion at a temperature between about 40° to 70° C.,
   crosslinking the polymer at a temperature between about 110° and 120° C., and then
   drying the sheet at a temperature between about 100° to 160° C.

8. The process of claim 1 or 7 wherein the water soluble alcohol is selected from the group consisting of ethylene glycol, diethylene glycol, glycerol, polyethylene glycol or polypropylene glycol.

9. The process of claim 1 or 7 wherein the aqueous emulsion is an emulsion of 3-methoxy butyl acetate.

10. The process of claim 1 wherein a water soluble condensation product of dioxydiphenyl sulfone and paraphenol sulfonic acid is used as the condensation product.

* * * * *